US010507652B2

(12) United States Patent
Tse et al.

(10) Patent No.: US 10,507,652 B2
(45) Date of Patent: Dec. 17, 2019

(54) RAPIDLY-WETTED PIN-STYLE ELECTRO-HYDRODYNAMIC JET PRINT HEAD

(71) Applicant: The Regents of The University of Michigan, Ann Arbor, MI (US)

(72) Inventors: Lai Yu Leo Tse, Ann Arbor, MI (US); Kira Barton, Ann Arbor, MI (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 0 days.

(21) Appl. No.: 15/921,103

(22) Filed: Mar. 14, 2018

(65) Prior Publication Data

US 2019/0283407 A1 Sep. 19, 2019

(51) Int. Cl.
*B41J 2/045* (2006.01)
*B41J 2/165* (2006.01)
*B41J 2/175* (2006.01)

(52) U.S. Cl.
CPC ..... *B41J 2/04583* (2013.01); *B41J 2/16544* (2013.01); *B41J 2/16552* (2013.01); *B41J 2/175* (2013.01); *B41J 2002/16558* (2013.01); *B41J 2002/16567* (2013.01)

(58) Field of Classification Search
CPC B41J 2/04583; B41J 2/16544; B41J 2/16552; B41J 2/175; B41J 2002/16558; B41J 2002/16567; B41J 2/25; B41J 2/305; B41J 2002/14322; B41J 2002/14395
See application file for complete search history.

(56) References Cited

U.S. PATENT DOCUMENTS 4,314,263 A * 2/1982 Carley ..... G01D 15/18 347/44
9,415,590 B2 8/2016 Barton et al.
2004/0227785 A1* 11/2004 Katsuta ..... B41J 2/16585 347/33
2006/0081643 A1 4/2006 Haluzak et al.
2011/0199433 A1 8/2011 Kim et al.
2012/0105528 A1 5/2012 Alleyne et al.
2014/0322451 A1 10/2014 Barton et al.
(Continued)

FOREIGN PATENT DOCUMENTS

EP 3050706 A1 8/2016

OTHER PUBLICATIONS

Y. Han and J. Dong. "Design of Integrated Ring Extractor for High Resolution Electrohydrodynamic (EHD) 3D Printing." Procedia Manufacturing 5 pp. 1031-1042 (2016).
(Continued)

*Primary Examiner* — Henok D Legesse
(74) *Attorney, Agent, or Firm* — Harness, Dickey & Pierce, P.L.C.

(57) ABSTRACT

A print head assembly for printing an ink on a substrate having a printing pin member having a tip; a wetting system having an ink reservoir, the wetting system being configured to transfer ink from the ink reservoir to the tip of the printing pin member; and a charging system operably coupled to the printing pin member, the charging system configured to apply a high voltage charge to the printing pin member resulting in the ink on the tip of the printing pin member to be deposited upon the substrate.

14 Claims, 3 Drawing Sheets

(56) References Cited

U.S. PATENT DOCUMENTS

2015/0336388 A1* 11/2015 Ohnishi ..... B41J 2/16552
347/28

OTHER PUBLICATIONS

L. Y. L. Tse and K. Barton. "A Field Shaping Printhead for High-Resolution Electrohydrodynamic Jet Printing onto Non-Conductive and Uneven Surfaces." Applied Physics Letters 104, No. 14, pp. 143510 (2014).

J.S. Lee, Y.J. Kim, B.G. Kang, S.Y. Kim, J. Park, J. Hwng, and Y.J. Kim. "Electrohydrodynamic Jet Printing Capable of Removing Substrate Effects and Modulating Printing Characteristics." In Micro Electro Mechanical Systems, 2009. MEMS 2009. IEEE 22nd International Conference on, pp. 487-490. IEEE, 2009.

Y. Pan, Y.A. Huang, L. guo, Y. Ding, and Z. Yin. "Addressable Multi-Nozzle Electrohydrodynamic Jet Printing with High Consistency by Multi-Level Voltage Method." AIP Advances 5, No. 4, pp. 047108, 2015.

Xu, Lei, and Daoheng Sun. "Electrohydrodynamic Printing Under Applied Pole-Type Nozzle Configuration." Applied Physics Letters 102, No. 2 (2013): 024101.

Park, J. U., Hardy, M., Kang, S. J., Barton, K., Adair, K., kishore Mukhopadhyay, D., . . . & Ferreira, P. M. (2007). High-resolution electrohydrodynamic jet printing. Nature materials, 6(10), 782.

International Search Report and Written Opinion of the International Searching Authority issued in PCT/US2019/021747, dated Jun. 25, 2019.

* cited by examiner

RAPIDLY-WETTED PIN-STYLE ELECTRO-HYDRODYNAMIC JET PRINT HEAD

GOVERNMENT INTEREST

This invention was made with government support under Grant No. CMMI-1351469, awarded by the National Science Foundation. The Government has certain rights in the invention.

FIELD

The present disclosure relates to a jet print head and, more particularly, relates to a rapidly-wetted pin-style electro-hydrodynamic jet print head.

BACKGROUND AND SUMMARY

This section provides background information related to the present disclosure which is not necessarily prior art. This section provides a general summary of the disclosure, and is not a comprehensive disclosure of its full scope or all of its features.

Existing e-jet print head designs aimed at reducing the standoff height effect on deposition volume involve a nozzle extractor ring mechanism. However, the present teachings vary from conventional designs in several ways. In some embodiments, the present teachings employ a conductive rod rather than a nozzle with an inner fluid channel, and a secondary rod/nozzle that serves as a reservoir for the printing process. In some embodiments, the present teachings employ a wetting system that releases a controlled volume of material on the surface of the conductive rod and an automated rod positioner that moves the ejection rod away from the reservoir to mitigate interference between these two components.

According to the principles of the present teachings, two major printing challenges within the electrohydrodynamic jet (e-jet) printing industry are addressed. The present teachings mitigate the nozzle clogging issues present in electro-hydrodynamic jet printing with nozzles containing <10 micron openings, and decouple the relationship between printing volume and standoff height of the printing nozzle, therefore promoting consistent amounts of ink to be deposited onto the printing surface even if the printing surface is not flat.

Many inks with a low boiling point (high volatility) are used for inkjet printing; however, the application of these materials in the e-jet printing process is limited due to challenges with ink evaporating and clogging the small openings of the e-jet nozzles. Using a pin (conductive, non-hollow rod with small dimensions) rather than a nozzle removes the use of a small orifice in the printing process, therefore removing the potential for a clogging issue to occur during the printing process.

Conventional e-jet suffers from the influence of standoff height (distance between the nozzle and the substrate) on the printing process. Variations in standoff height result in non-consistent volume ejection during the printing process, which leads to inconsistent and uncontrollable printed patterns.

The present teachings limit the amount of ink that can be released from the pin at a given time through the use of a wetting system. In some embodiments, the wetting system of the present teachings delivers a consistent amount of ink to the tip of the pin. With a controlled volume of ink at the tip of the nozzle, the volume of ink deposited at each printing location will be the same and the standoff height will no longer influence the deposition volume.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
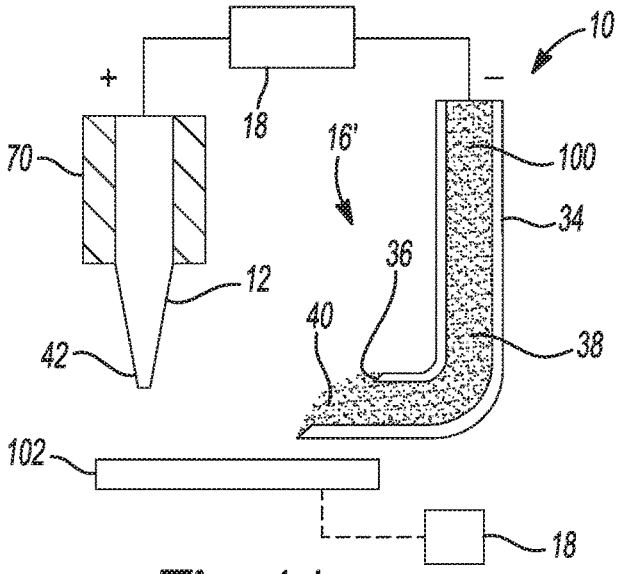
FIG. 1A is a schematic cross-sectional view illustrating a rapidly-wetted pin-style electro-hydrodynamic jet print head assembly according to a first embodiment in a default position.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

According to the principles of the present teachings as illustrated in FIGS. 1A-3F, a rapidly-wetted pin-style electro-hydrodynamic jet print head assembly 10 is provided having advantageous construction and method of use. In some embodiments, print head assembly 10 comprises a printing pin or needle member 12, an optional pin cleaning system 14, a wetting system 16 (16', 16", 16'''), and a charging system 18 for charging printing pin member 12 and/or grounding wetting system 14.

In some embodiments, printing pin member 12 is an ejection pin configured to eject ink 100 upon a substrate 102. Print head assembly 10 is configured to enable printing using previously unprintable ink materials 100, such as but not limited to alcohols, materials with high evaporation rates, high viscosity solvents with dissolved particles, larger particle suspensions, and the like that would previously result in clogging problems in conventional print heads. Moreover, print head assembly 10 is configured to accurately control the amount of ink 100 released onto the surface of substrate 102. Still further, print head assembly 10 is configured to control the duration of ink drying (which changes the ink rheology) before the ink droplet 100' is released into the air and lands on substrate 102 as deposited ink 100".

In some embodiments, printing pin member 12 can be made of a conductive material to provide an associated electrical charge from charging system 18 to facilitate electro-hydrodynamic application of ink 100. Printing pin member 12 can comprise a readily-wettable outer surface (metal surface for polar inks 100 or surfaced treated for high wettability of non-polar inks 100). In some embodiments, printing pin member 12 can define a tip diameter in the range of 1-20 μm.

In some embodiments, wetting system 16 is configured to provide ink 100 to printing pin member 12 for application upon substrate 102. Wetting system 16 can comprise any one of a number of configurations for use with printing pin member 12. As illustrated in FIGS. 1A-1E, wetting system 16' can comprise an external ink reservoir 34 fluidly containing and communicating ink 100 to an open end 36. In this embodiment, external ink reservoir 34 is separate from printing pin member 12 as illustrated. In some embodiments, reservoir 34 can be generally L-shaped having an internal volume 38 and an upwardly-angled open end 36. The upwardly-angled open end 36 can promote formation of an ink meniscus 40.

Figure 1B:
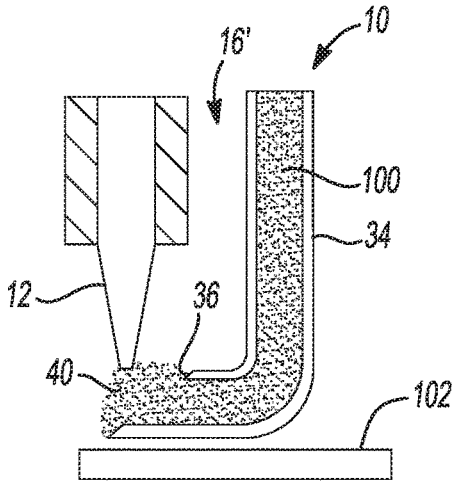
FIG. 1B is a schematic cross-sectional view illustrating the rapidly-wetted pin-style electro-hydrodynamic jet print head assembly according to the first embodiment in a wetting position.

With continued reference to FIGS. 1A-1B, it should be recognized that ink reservoir 34 and printing pin member 12 are configured to be moved into proximity of each other such that a distal tip 42 of printing pin member 12 contacts meniscus 40 or is sufficiently close to transfer ink 100 to distal tip 42. To this end, ink reservoir 34 and/or printing pin member 12 can be mechanically moveable relative to each other.

As illustrated in FIGS. 2A-2D, wetting system 16" can comprise an embedded nozzle-in-nozzle configuration wherein printing pin member 12 is coaxially disposed within an ink reservoir 44 fluidly containing and communicating ink 100 to an open end 46. In this embodiment, ink reservoir 44 surrounds printing pin member 12 as illustrated and is moveable relative thereto (e.g. printing pin member 12 can be selectively extended out of open end 46 of ink reservoir 44 and fully retracted therein via mechanical system 50). In some embodiments, reservoir 44 can be generally cylindrically-shaped having an internal volume 48 and a generally flat or orthogonal open end 46.

As illustrated in FIGS. 3A-3F, wetting system 16''' can comprise an external ink reservoir 54 fluidly containing and communicating ink 100 to an open end 56. In this embodiment, external ink reservoir 54 is separate from printing pin member 12 as illustrated. In some embodiments, reservoir 54 can be generally cylindrically-shaped having an internal volume 58 and a generally flat or orthogonal open end 56. Ink reservoir 54 can further comprise an extension pin member 60 coaxially disposed within ink reservoir 54. In this embodiment, ink reservoir 54 surrounds extension pin member 60 as illustrated and is moveable relative thereto (e.g. extension pin member 60 can be selectively extended out of open end 56 of ink reservoir 54 and fully retracted therein via mechanical system 62).

Figure 1C:
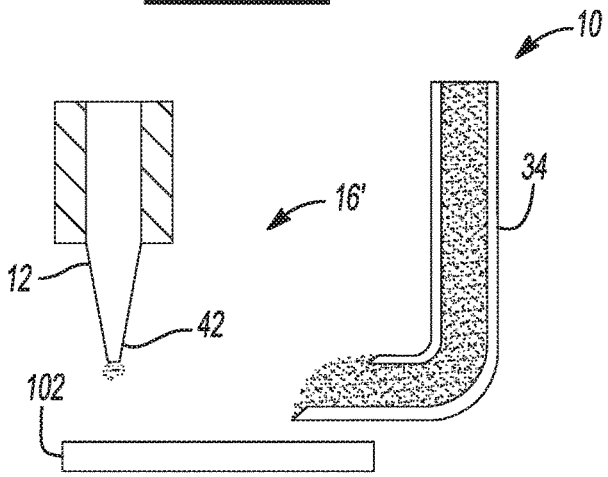
FIG. 1C is a schematic cross-sectional view illustrating the rapidly-wetted pin-style electro-hydrodynamic jet print head assembly according to the first embodiment in a drying position.
Figure 1D:
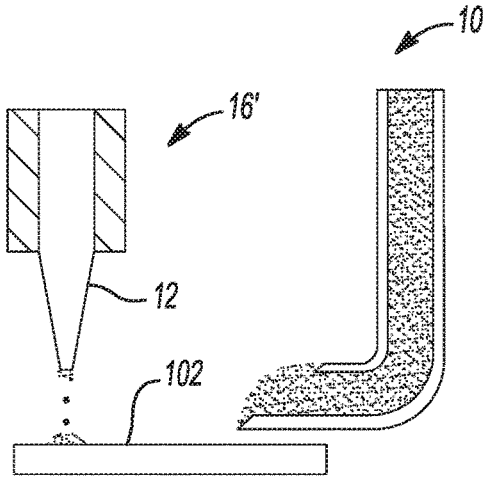
FIG. 1D is a schematic cross-sectional view illustrating the rapidly-wetted pin-style electro-hydrodynamic jet print head assembly according to the first embodiment in a depositing position.
Figure 1E:
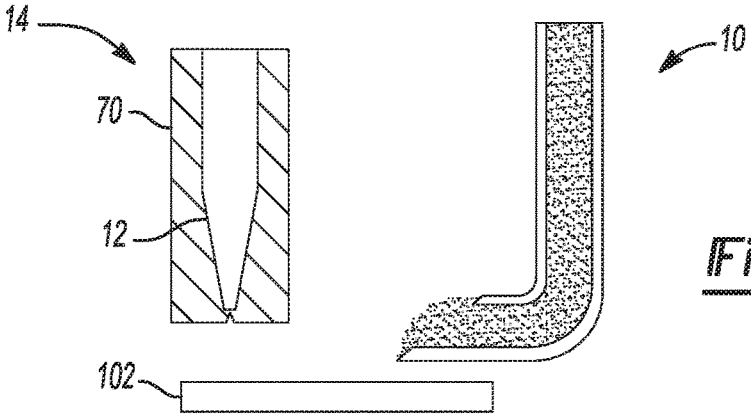
FIG. 1E is a schematic cross-sectional view illustrating the rapidly-wetted pin-style electro-hydrodynamic jet print head assembly according to the first embodiment in a cleaning position.
Figure 3A:
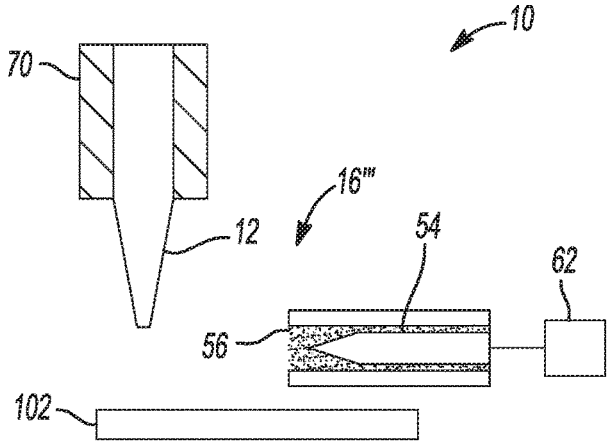
FIG. 3A is a schematic cross-sectional view illustrating a rapidly-wetted pin-style electro-hydrodynamic jet print head assembly according to a third embodiment in a default position.
Figure 3B:
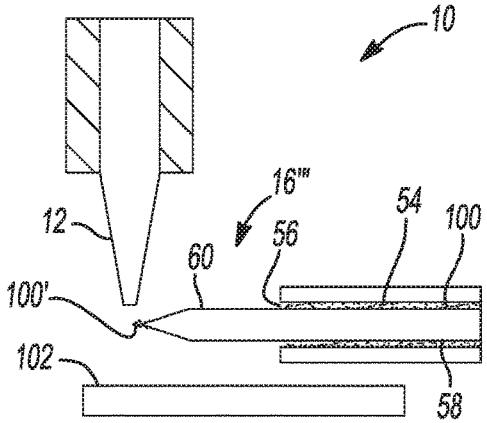
FIG. 3B is a schematic cross-sectional view illustrating the rapidly-wetted pin-style electro-hydrodynamic jet print head assembly according to the third embodiment in a wetting position with an extension pin member extended.
Figure 3C:
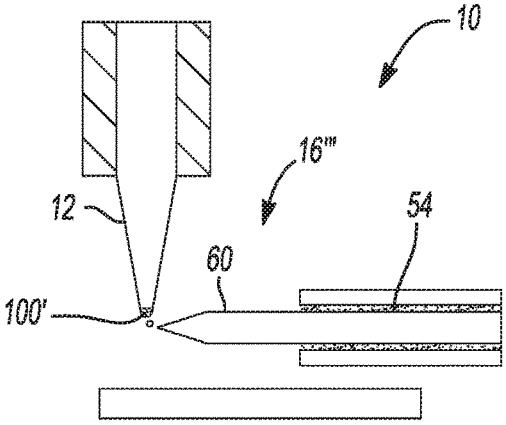
FIG. 3C is a schematic cross-sectional view illustrating the rapidly-wetted pin-style electro-hydrodynamic jet print head assembly according to the third embodiment in a wetting position with the extension pin member extended and ink transferred.
Figure 3D:
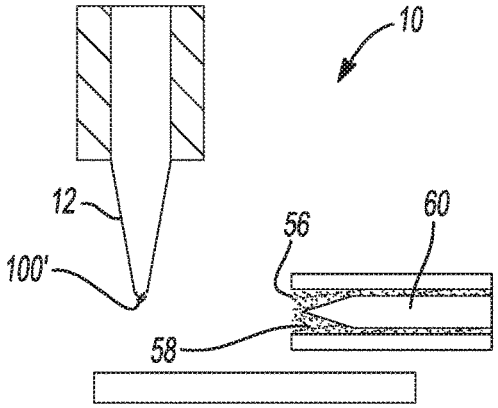
FIG. 3D is a schematic cross-sectional view illustrating the rapidly-wetted pin-style electro-hydrodynamic jet print head assembly according to the third embodiment in a drying position with the extension pin member retracted.
Figure 3E:
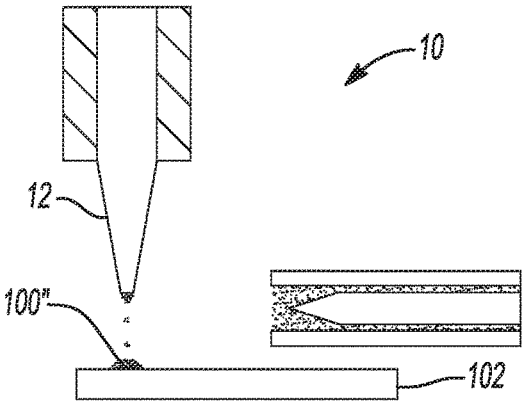
FIG. 3E is a schematic cross-sectional view illustrating the rapidly-wetted pin-style electro-hydrodynamic jet print head assembly according to the third embodiment in a depositing position.
Figure 3F:
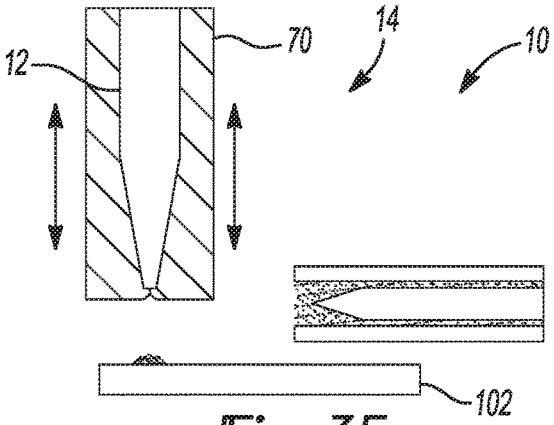
FIG. 3F is a schematic cross-sectional view illustrating the rapidly-wetted pin-style electro-hydrodynamic jet print head assembly according to the third embodiment in a cleaning position.

In some embodiments, as illustrated in FIGS. 1A-1E, 2D, and 3A-3F, pin cleaning system 14 can comprise a sponge member 70 generally surrounding and contacting print pin member 12. As illustrated in FIGS. 1E and 3F, sponge member 70 can be a solvent soaked sponge that moves relative to the outer surface of printing pin member 12 to apply a cleaning action, after which sponge member 70 can return to a retracted position (see FIGS. 1A-1D and 3A-3E). In some embodiments, pin cleaning system 14 can comprise an ultrasonic system 72 (see FIG. 2D). Pin cleaning system 14 can be actuated when necessary or between print cycles.

The printing process works by first wetting print pin member 12 by charging print pin member 12 to draw a controlled amount of ink 100 from the exposed reservoir (i.e. ink meniscus 40) or the tip of extension pin member 60 onto the tip of print pin member 12. The wetting process is repeated with a set of controlled parameters (i.e. distance between the extension pin member 60 and printing pin member 12, charging voltage, pulse width, etc.), ensuring that the amount of ink 100 that is delivered to the tip of printing pin member 12 is controlled and consistent.

Once printing pin member 12 is wetted, wetting system 16 is rapidly moved away from printing pin member 12 using a mechanical system. After a pre-defined wait time for the ink 100 to dry (can be as short as a few milliseconds), printing pin member 12 will be charged above the substrate 102 to release the ink from the tip pf printing pin member 12 to the surface of substrate 102. The high voltage charged printing pin member 12 can polarize the surface of substrate 102 and, as such, this design can work on both conductive and non-conductive substrates. Given the controlled release of ink from the reservoir to the pin tip, the volume of material released is consistent from droplet to droplet.

After printing the droplets 100" onto the surface of substrate 102, there may be ink residue on printing pin member 12. To clean printing pin member 12 and reset the surface condition of printing pin member 12, pin cleaning system 14 is activated to remove the ink residue on printing pin member 12.

In some embodiments, the present teachings can be used for fabrication of sensors/devices (e.g. biological, electrical, optical) that contain particle suspensions in solvent materials with low vapor pressure, high evaporation rates, or high volatility (e.g. Isopropyl alcohol, water, ethanol) and e-jet printing on contoured and flexible surfaces, such as for printed electronics or smart surfaces.

In some embodiment, the present teachings can be scaled up for use in large printing pin arrays for mass production. The controlled volume reduces effects of standoff height variation among arrays and mitigates volume variations due to electric field variations from neighboring nozzles.

During operation, printing pin member 12 starts at a default position (see FIG. 1A). Ink reservoir 34 moves towards printing pin member 12, in some embodiments. As printing pin member 12 is positively charged, the ink 100 from ink reservoir 34 wets the outer surface of printing pin member 12 (FIG. 1B). The ink reservoir 34 moves away from printing pin member 12. The wetted printing pin member 12 may stay in the air for a predefined period of time for the ink to dry up and reach the ideal ink rheology (FIG. 1C). Once the predefined drying time has passed, printing pin member 12 is charged with high voltage and the ink droplet 100' with a fixed volume is deposited (at 100") onto the surface of substrate 102 (FIG. 1D). The solvent soaked sponge 14 will move up and down to clean the outer surface of printing pin member 12, and the print head will return to the default state again, ready for the next round of printing (FIG. 1E).

Figure 2A:
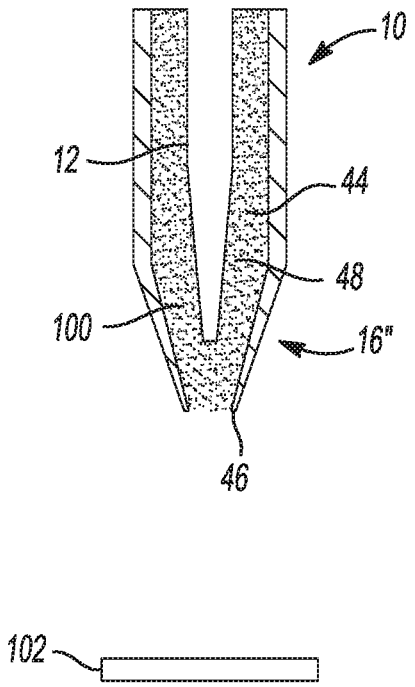
FIG. 2A is a schematic cross-sectional view illustrating a rapidly-wetted pin-style electro-hydrodynamic jet print head assembly according to a second embodiment in a default and wetting position.
Figure 2B:
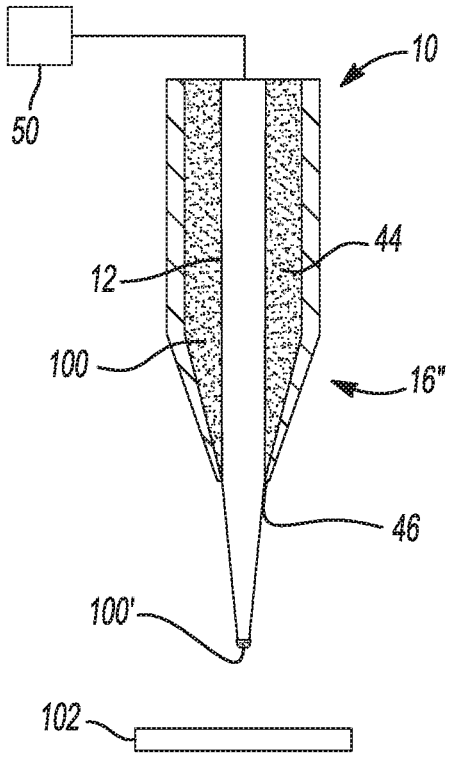
FIG. 2B is a schematic cross-sectional view illustrating the rapidly-wetted pin-style electro-hydrodynamic jet print head assembly according to the second embodiment in a drying position.
Figure 2C:
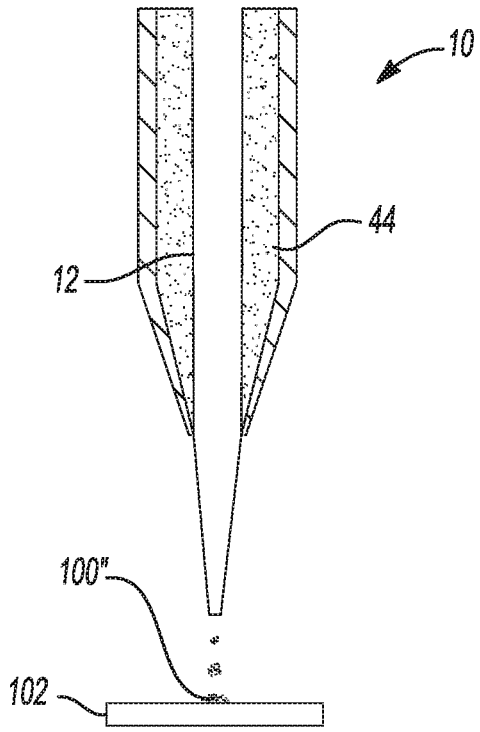
FIG. 2C is a schematic cross-sectional view illustrating the rapidly-wetted pin-style electro-hydrodynamic jet print head assembly according to the second embodiment in a depositing position.
Figure 2D:
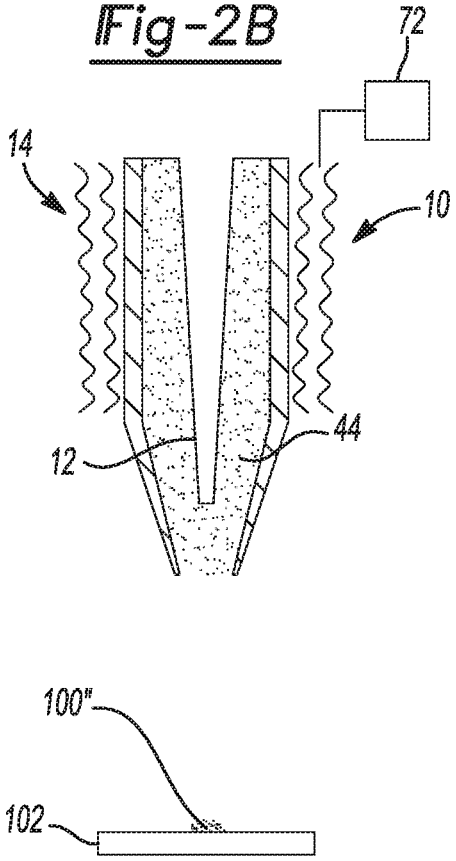
FIG. 2D is a schematic cross-sectional view illustrating the rapidly-wetted pin-style electro-hydrodynamic jet print head assembly according to the second embodiment in a cleaning position.

With reference to FIGS. 2A-2D, printing pin member 12 can comprise wettability coatings or properties on the outer surface thereof. Without such surface properties, it may be difficult to obtain a predetermined amount of ink 100 on printing pin member 12 when extended beyond ink reservoir 44. Accordingly, printing pin member 12 extends out of ink reservoir 44 with a fixed volume of ink 100' on the tip of printing pin member 12. Printing pin member 12 stays in this position for a predefined period of time, which allows the ink to dry and reach the ideal ink rheology. Once the predefined drying time has passed, printing pin member 12 is charged with high voltage and the ink droplet 100' with a fixed volume is deposited (at 100") onto the surface of substrate 102 (FIG. 2C).

After the jetting is completed, printing pin member 12 will retract back into the ink reservoir and the needle will be ultrasonically cleaned (see FIG. 2D) within ink reservoir 44, which will help dissolve the dried up ink coating on the tip of printing pin member 12. The substrate 102 can be grounded, grounded underneath, or stay electrically floating. The printed droplet size can range from 100 nm-30 μm.

As seen in FIGS. 3A-3F, the present teachings employ a wetting mechanism that is electro-hydrodynamically driven (as opposed to simply submerging the printing tip into the ink). This electrohydrodynamic wetting can precisely control the amount of ink that wets printing pin member 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A print head assembly for printing an ink on a substrate, the print head assembly comprising:

a printing pin member having a tip;

a wetting system separate from the printing pin member, the wetting system having an ink reservoir; and a charging system operably coupled to the printing pin member, the charging system configured to apply a voltage charge to the printing pin member to electro-hydrodynamically transfer ink from the wetting system to the printing pin member.

2. The print head assembly according to claim 1, further comprising:

a pin cleaning system configured to clean ink from the printing pin member.

3. The print head assembly according to claim 2 wherein the pin cleaning system comprises a sponge member surrounding the printing pin member, the sponge member configured to carry a solvent, and a mechanical system operably coupled to the sponge member to move the sponge member in contact with and relative to the printing pin member.

4. The print head assembly according to claim 2 wherein the pin cleaning system comprises an ultrasonic cleaning system.

5. The print head assembly according to claim 1 wherein the ink reservoir of the wetting system comprises an open end, the open end configured to form an ink meniscus such that the tip physically contacts the ink meniscus.

6. The print head assembly according to claim 1 wherein the charging system is operably coupled to the printing pin member and the wetting system, the charging system configured to apply a voltage charge to at least one of the printing pin member and the wetting system to electro-hydrodynamically transfer ink from the wetting system to the printing pin member.

7. The print head assembly according to claim 1 wherein the ink reservoir of the wetting system comprises an open end and an extension pin member coaxially disposed within the ink reservoir, the extension pin member being selectively actuated to extend beyond the open end and electro-hydrodynamically transfer ink to the printing pin member.

8. The print head assembly according to claim 1 wherein the charging system is operably coupled to the printing pin member and the wetting system, the charging system configured to apply a voltage charge to the printing pin member and the wetting system to electro-hydrodynamically transfer ink from the wetting system to the printing pin member.

9. A print head assembly for printing an ink on a substrate, the print head assembly comprising:

a printing pin member having a tip;

a wetting system having an ink reservoir, the wetting system being configured to transfer ink from the ink reservoir to the tip of the printing pin member; and a charging system operably coupled to the printing pin member, the charging system configured to apply a high voltage charge to the printing pin member, wherein the ink reservoir of the wetting system comprises an open end and an extension pin member coaxially disposed within the ink reservoir, the extension pin member being selectively actuated to extend beyond the open end and electro-hydrodynamically transfer ink to the printing pin member.

10. The print head assembly according to claim 9, further comprising:

a pin cleaning system configured to clean ink from the printing pin member.

11. The print head assembly according to claim 10 wherein the pin cleaning system comprises a sponge member surrounding the printing pin member, the sponge member configured to carry a solvent, and a mechanical system operably coupled to the sponge member to move the sponge member in contact with and relative to the printing pin member.

12. The print head assembly according to claim 10 wherein the pin cleaning system comprises an ultrasonic cleaning system.

13. The print head assembly according to claim 9 wherein the charging system is operably coupled to the printing pin member and the wetting system, the charging system configured to apply a high voltage charge to the printing pin member.

14. The print head assembly according to claim 9 wherein the charging system is operably coupled to the printing pin member and the wetting system, the charging system configured to apply a high voltage charge to the printing pin member and the wetting system to electro-hydrodynamically transfer ink from the wetting system to the printing pin member.

* * * * *